United States Patent [19]

Bollig et al.

[11] Patent Number: 4,832,177

[45] Date of Patent: May 23, 1989

[54] HINGED CHANNEL FOR STEEL BARS

[76] Inventors: Georg Bollig, Roonstrasse 8, D-1450 Krefeld; Cyril Pazderka, Doerper Weg 16, D-4005 Meerbusch, both of Fed. Rep. of Germany

[21] Appl. No.: 138,356

[22] Filed: Dec. 28, 1987

[30] Foreign Application Priority Data

Dec. 29, 1986 [DE] Fed. Rep. of Germany ..... 3644650

[51] Int. Cl.[4] ..... B21B 43/12

[52] U.S. Cl. ..... 198/451; 414/746.4

[58] Field of Search ..... 414/745, 748, 746.4; 198/448, 451, 452, 457, 463.4

[56] References Cited

U.S. PATENT DOCUMENTS

| | | | |
|---|---|---|---|
| 4,054,047 | 10/1977 | Sclippa | 414/748 X |
| 4,448,298 | 5/1984 | Matsuo | 198/451 |
| 4,505,374 | 3/1985 | Beerens et al. | 198/448 |
| 4,711,340 | 12/1987 | Duri | 414/748 X |

FOREIGN PATENT DOCUMENTS

| | | | |
|---|---|---|---|
| 1289813 | 2/1969 | Fed. Rep. of Germany | 414/748 |
| 141794 | 5/1980 | German Democratic Rep. | 414/748 |
| 7011686 | 2/1972 | Netherlands | 414/748 |

*Primary Examiner*—Leslie J. Paperner

*Attorney, Agent, or Firm*—Barnes & Thornburg

[57] ABSTRACT

A hinged channel for receiving steel bars (11, 12), cut to predetermined lengths and discharged from a rolling mill is described. The steel bars are slowed down during or at the end of entry into the hinged channel. After stopping or just before stopping, they are fed onto an underlying cooling bed by opening the hinged channel. The hinged channel has at least two parallel, randomly chargeable channels (5, 6) with different cross-sections. As a function of the cross-section or diameter of the discharged steel bar either the channel with the smaller diameter or that with the larger diameter is charged. A common pivotable cover (10) is provided for both channels, which closes the same in one position and releases the same in the other position so that the steel bar located in one of the channels can drop onto the cooling bed.

9 Claims, 2 Drawing Sheets

Figure 2:
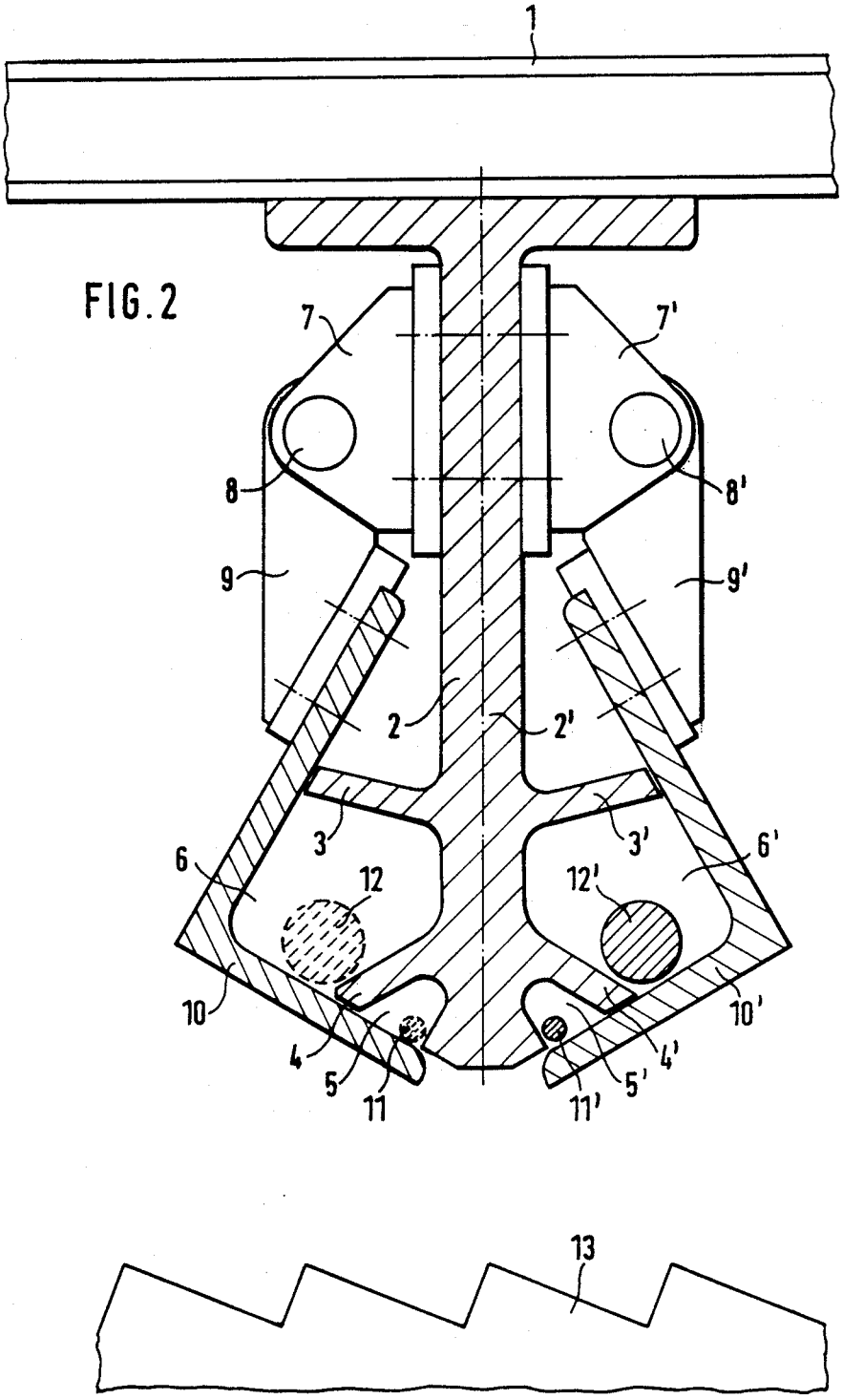

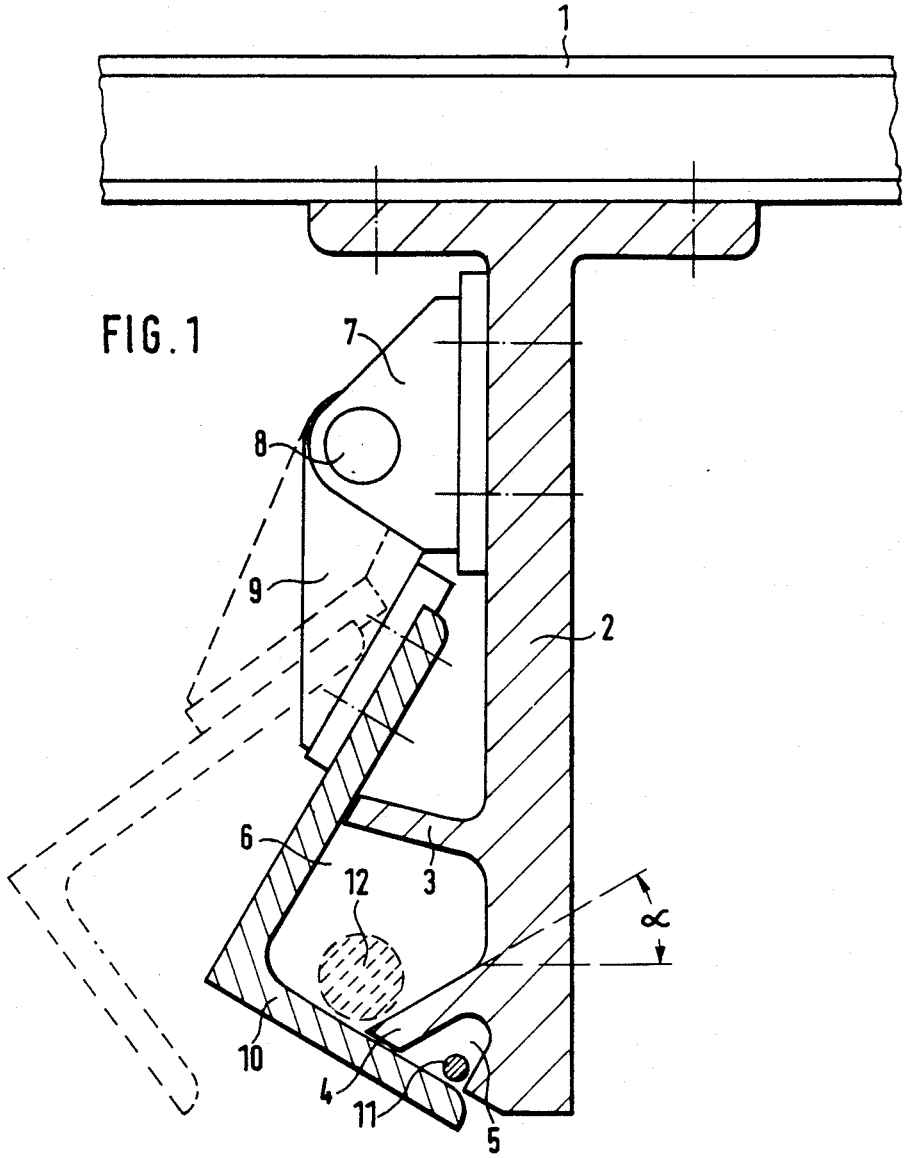
FIG. 1
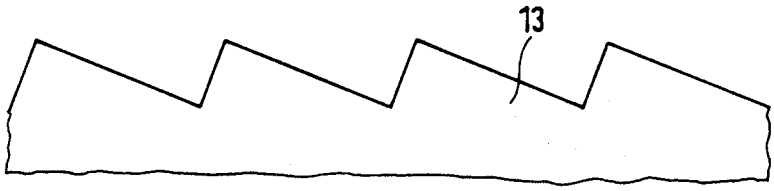

HINGED CHANNEL FOR STEEL BARS

The invention relates to a hinged channel for receiving rolled steel bars discharged from a continuous rolling mill. More particularly, the invention relates to a device having two differently sized channels with a common hinged cover for receiving and selectively dropping differently sized steel bars.

Bars passing out of a rolling mill and cut by shears into cooling bed length are initially alternately guided by means of a diverter into one of two parallel hinged channels, troughs or ducts in each case forming one strand. Beneath the hinged channels is located a cooling bed and on it, after reaching a stationary state, are placed the bars which have been slowed down on entering the hinged channels. Slowing down is brought about by brake drivers, which are arranged in the path of the bars immediately upstream of the cooling bed and engage the rear end of the bar entering the hinged channel and slow down the same in controlled manner. For placing a bar on the cooling bed, the hinged channel containing the bar is opened, so that the said bar drops onto the rake part of the cooling bed located beneath the channel. This rake part conventionally comprises fixed and movable rakes and conveys in stepwise manner the bars dropping out of the hinged channels.

Steel bars with widely differing cross-sections are rolled. They are always guided through a hinged channel with the same free internal cross-section, which must be based on the maximum cross-section of a bar to be rolled. Very thin bars, e.g. round bars with a diameter of 8 mm, are consequently not adequately guided and can rapidly chatter as a result of the high entry speed. This can damage the bars and cause problems in the production sequence. In order to solve this problem, the hinged channels are always provided in duplicate, i.e. two separate channels are provided with a varying free internal cross-section for each strand. However, this measure is very costly. According to another known solution, on modifying the cross-section of the rolled bars, the installed hinged channels are optionally replaced by those with a different internal cross-section. However, this procedure is very time consuming and leads to long interruptions of production on changing the hinged channels.

The problem of the present invention is consequently to provide a hinged channel which, at low cost, ensures that it is possible to guide steel bars with a small and also with a relatively large cross-section in such a way that chattering cannot occur.

Thus, only a single hinged or tilting mechanism is provided for each strand, so that compared with the construction with two separate hinged channels, a considerable reduction in costs is achieved.

The at least two channels with different cross-sections of a hinged channel are preferably formed by a common casting. This leads to a further simplification, so that the costs for an inventive hinged channel are essentially no higher than those for a conventional hinged channel with only one continuous channel for all the steel bars, independently of the cross-sectional surface thereof.

A further simplification of the hinged channel is obtained in that its at least two channels are formed with the at least two channels of different cross-section of an adjacent hinged channel by a common casting.

The invention is described in greater detail hereinafter relative to non-limitative embodiments and the attached drawings, wherein show:

FIG. 1: A hinged channel in cross-section.

FIG. 2: Two hinged channels integrated into a single casting, also in cross-section.

The hinged channel according to FIG. 1 is fixed to a support 1 and extends at right angles to the plane of the drawing. It has a casting 2, which projects vertically downwards from support 1 and carries two lugs 3, 4. Between lug 4 and the lower end of casting 2 widened towards lug 4 is provided a channel 5 with a relatively small cross-section and between lugs 3 and 4 is formed a channel 6 with a relatively large cross-section. A bearing 7 for a rotary shaft 8 is fixed to the upper part of casting 2. A wedge 9 carrying a cover 10 is fixed to shaft 8. Through rotation of shaft 8 controlled in an appropriate manner, it is possible to pivot cover 10 between the position shown in continuous line form and that shown in broken line form. In the position shown in continuous line form the two channels 5, 6 are closed by cover 10, whereas in the position shown in broken line form channels 5, 6 are open in downwardly sloping manner. Channels 5, 6 are used for temporarily receiving steel bars which, arriving from a rolling mill at right angles to the plane of the drawing, are introduced into the channels and slowed down. Measures are taken to ensure that into channel 5 are only introduced those steel bars which do not exceed a given diameter, e.g. 15 mm, or cross-section, whereas into channel 6 are only introduced those bars, which exceed this diameter or cross-section. Corresponding round bars are shown in channels 5 and 6, e.g. in channel 5 there is a bar 11 with a diameter of approximately 8 mm and in channel 6 a bar with a diameter of approximately 36 mm. The bars run at high speed, e.g. more than 30 m/sec into the channels, prior to the slowing down thereof. At such high speeds the bars have a chattering tendency, but this is eliminated in that through the subdivision into two channels of different cross-sections, the ratio of the free channel cross-section and bar cross-section does not become too large. Thus, for each bar and independently of its cross-section, the channels form an adequate guide, so that there can be no chattering of the bars. When a bar enters channel 5 or 6 and is slowed down, shaft 8 is pivoted in such a way that cover 10 assumes the position shown in continuous line form. The incoming bar is cosequently secured against dropping out of the particular channel. After the bar has been stopped or almost stopped, cover 10 is opened by pivoting shaft 8, i.e. is brought into the position shown by broken lines, so that bar 11 can roll down from the adjacent edge of casting 2 or bar 12 can roll down from lug 4 and can drop onto a cooling bed rake 13 on which it is subsequently advanced in stepwise manner. In order to ensure that the bars do not fall out of the particular channel, their roll or slide off planes are inclined by at least 30° with respect to the horizontal, i.e. the angle $\alpha$ between lug 4 and the horizontal is at least 30°.

The illustrated hinged channel is preferably not manufactured in one piece in the longitudinal direction, because this would lead to manufacturing problems as a result of its length. It therefore comprises several sections with the same cross-section successively arranged in the longitudinal direction. Shafts 8 of the individual sections are coupled together in such a way as to ensure a simultaneous opening or closing of all the hinged channel covers.

The decision as to which of the two channels 5 or 6 is to be loaded or charged, is a function of the diameter or cross-section of the rolled bar and the supply to the hinged channel must be correspondingly controlled. This can e.g. be vertically and/or laterally adjustable, so that the steel bar is deflected into the selected channel 5 or 6. It is also possible to provide a stationary supply having a slot or the like through which can pass the steel bars which are to be led into the channel 5, whilst the bars which are to be received by channel 6, as a result of their larger diameter or cross-section, cannot pass through said slot.

When a steel casting passes out of a rolling mill, it is conventional practice to use two hinged channels, which are alternately charged. This takes place in such a way that whilst one bar is slowed down in one hinged channel, the following bar runs into the other hinged channel. This permits a continuous discharge of the steel castings from the rolling mill. FIG. 2 shows a particularly simple construction of a combination of two such hinged channels. The hinged channel according to FIG. 1 is consequently duplicated, in such a way that it is formed from an individual casting with a common central part 2, 2' at right angles to support 1 and to whose two sides channels 5, 6 and 5', 6' are symmetrically constructed. In FIG. 2 the reference numerals relating to the hinged channel symmetrical to the hinged channel shown in FIG. 1 are provided with an apostrophe. Not only casting 2, 2' with lugs 3, 3', 4, 4' is symmetrically constructed, but also the associated bearings 7, 7', shafts 8, 8', wedges 9, 9' and covers 10, 10'. Covers 10, 10' are alternately opened and closed.

We claim:

1. A device for receiving rolled steel bars having different sizes discharged from a continuous rolling mill, the device comprising, a support member, a first channel attached to the support member for receiving steel bars larger than a first specified size, the first channel having an upper retaining wall and a lower retaining wall which cooperate to define a first cross sectional area, a separate second channel attached to the support member for receiving steel bars smaller than the first specified size, the second channel having an upper retaining wall and a lower retaining wall which cooperate to define a second cross sectional area, the second cross sectional area being smaller than the first cross sectional area, and a selectively releasable cover member that covers both the first channel and the second channel to retain the steel bars in the first channel and the second channel and which is releasable to permit the steel bars to drop out of the first channel and the second channel onto a cooling bed.

2. The device of claim 1, wherein the first channel lower wall and the second channel lower wall are both inclined downwardly at least 30° with respect to horizontal to permit the steel bars to drop out of the respective channel.

3. The device of claim 2, wherein the first channel and the second channel are positional adjacent each other on the support member with the first channel lower wall and the second channel upper wall being a common wall to both channels.

4. The device of claim 3, wherein the support member is oriented vertically and the first channel upper wall, the second channel lower wall, and the common first channel lower wall and second channel upper wall are all formed from outwardly protruding arms that are cantilevered from the support member.

5. The device of claim 4, further comprising a rotatable shaft coupled to the cover to move the cover between a first position where both the first and second channels are covered to a second position where both the first and second channels are open.

6. A device for receiving and temporarily holding and positioning rolled steel bars having different diameters that are discharged from a continuous rolling mill before the steel bars are dropped onto a cooling bed for cooling, the device comprising, a generally vertical stationary support member, a first longitudinally extending receiving channel attached to one side of the support member for receiving steel bars with diameters greater than a specified diameter, the first channel having an upper retaining wall and a lower retaining wall which cooperate to define a first cross-sectional area within the first channel, the lower retaining wall being inclined downwardly with respect to horizontal a first predetermined angle, a second longitudinally extending receiving channel separate from the first channel and attached to the one side of the support member for receiving steel bars with diameters smaller than the specified diameter, the second channel having an upper retaining wall and a lower retaining wall which cooperate to define a second cross-sectional area within the second channel, the second cross-sectional area being smaller than the first cross-sectional area, the second channel lower retaining wall being inclined downwardly with respect to horizontal a second predetermined angle, and a pivotable cover that is pivotable from a first closed position where the cover closes both the first channel and the second channel to retain the steel bars within the channels and a second open position where both the first and second channels are open to permit the steel bars to roll down the inclined first and second channel lower retaining walls onto the lower cooling bed.

7. The device of claim 6, wherein the first channel lower retaining wall and the second channel upper retaining wall and both formed by a common protruding arm that is cantilevered from the one side of the support member.

8. The device of claim 6, wherein the specified diameter is equal to about 15 mm.

9. The device of claim 6, wherein the first and second predetermined angles are equal to at least 30°.

* * * * *